US006396333B2

(12) United States Patent
Dubhashi et al.

(10) Patent No.: US 6,396,333 B2
(45) Date of Patent: May 28, 2002

(54) CIRCUIT FOR SYNCHRONOUS RECTIFICATION WITH MINIMAL REVERSE RECOVERY LOSSES

(75) Inventors: Ajit Dubhashi, Redondo Beach; Brian Pelly, Palos Verdes Estates, both of CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 09/753,599

(22) Filed: Jan. 4, 2001

Related U.S. Application Data

(60) Provisional application No. 60/174,366, filed on Jan. 4, 2000, and provisional application No. 60/240,972, filed on Oct. 18, 2000.

(51) Int. Cl.[7] ..... G05F 3/02

(52) U.S. Cl. ..... 327/424; 327/533; 363/53; 363/127

(58) Field of Search ..... 327/390, 423, 327/424, 531, 589, 533; 323/282; 363/53, 89, 127

(56) References Cited

U.S. PATENT DOCUMENTS 5,355,077 A * 10/1994 Kates ..... 323/224
5,920,475 A * 7/1999 Boylan et al. ..... 363/127
5,929,692 A * 7/1999 Carsten ..... 327/531
5,940,287 A * 8/1999 Brkovic ..... 363/127
6,064,187 A * 5/2000 Redl et al. ..... 323/285
6,191,964 B1 * 2/2001 Boylan et al. ..... 363/89
6,229,292 B1 * 5/2001 Redl et al. ..... 323/285
6,243,278 B1 * 6/2001 Jacobs ..... 363/127
6,288,524 B1 * 9/2001 Tsujimoto ..... 323/285

* cited by examiner

*Primary Examiner*—Terry D. Cunningham
(74) *Attorney, Agent, or Firm*—Ostrolenk, Faber, Gerb & Soffen, LLP

(57) ABSTRACT

A circuit for synchronous rectification including two power MOSFET transistor switches in which the bottom switch is a P channel MOSFET, rather than an N channel MOSFET. The circuit of the present invention uses a single channel driver, rather than a dual driver and eliminates the deadtime associated with conventional circuits, thus minimizing reverse recovery losses. In an alternative arrangement, the position of the output filter is switched so that the N channel MOSFET conducts during the freewheeling time and the P channel MOSFET (with a larger RDSON) conducts during the conductor charge cycle.

2 Claims, 2 Drawing Sheets

CIRCUIT FOR SYNCHRONOUS RECTIFICATION WITH MINIMAL REVERSE RECOVERY LOSSES

This application claims the benefit of U.S. Provisional Application No. 60/174,366, filed Jan. 4, 2000 and U.S. Provisional Application No. 60/240,972, filed Oct. 18, 2000.

BACKGROUND OF THE INVENTION

1. Field of the Invention

The present invention relates to a circuit for synchronous rectification.

2. Description of the Related Art

The use of synchronous rectification in 'portable power' applications to reduce losses and improve efficiency is well known. A typical circuit configuration is shown in FIG. 1, where semiconductor switches 1 and 2 are both N channel power MOSFETs that are driven by a 'dual driver' 3. In some configurations, power MOSFET 1 can be reversed from the configuration shown in FIG. 1, which requires some changes in the driver arrangement. Current trends in the industry are to increase the switching frequency of the apparatus to gain advantages in the reduction of magnetics and capacitor sizes, and to improve transient response.

One of the disadvantages of the current approach shown in FIG. 1 is that the reverse recovery of the diode in power MOSFET 2 (caused by the turn on of power MOSFET 1) causes switching loss every cycle and thus reduces the power handling capacity and efficiency of the circuit. The reverse recovery losses can be reduced to some extent by having an optimal deadtime in the driver between the turnoff of the power MOSFET 2 transistor channel and the turn ON of the power MOSFET 1 transistor channel. This poses practical difficulties due to the necessity of having to accommodate a wide variety of MOSFETs, layouts, temperatures and voltages.

SUMMARY OF THE INVENTION

The topology of the present invention overcomes the reverse recovery phenomenon discussed above by the fundamental means of not requiring a 'deadtime' at all and ensuring that only the channels of the transistors conduct, rather than the diodes.

Other features and advantages of the present invention will become apparent from the following description of the invention which refers to the accompanying drawings.

DETAILED DESCRIPTION OF PREFERRED EMBODIMENT

Figure 1:
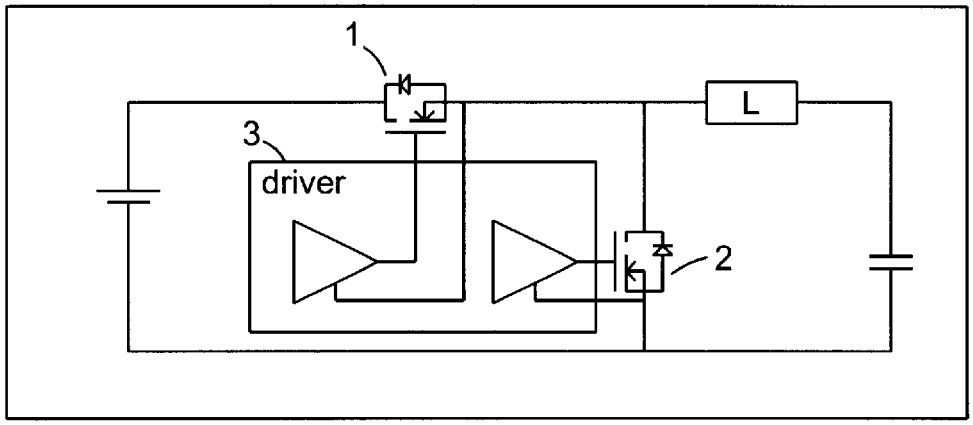
FIG. 1 (Prior Art)
FIG. 1 shows a prior art circuit synchronous rectification circuit in which two N channel MOSFETs are driven by a dual gate driver.
Figure 2:
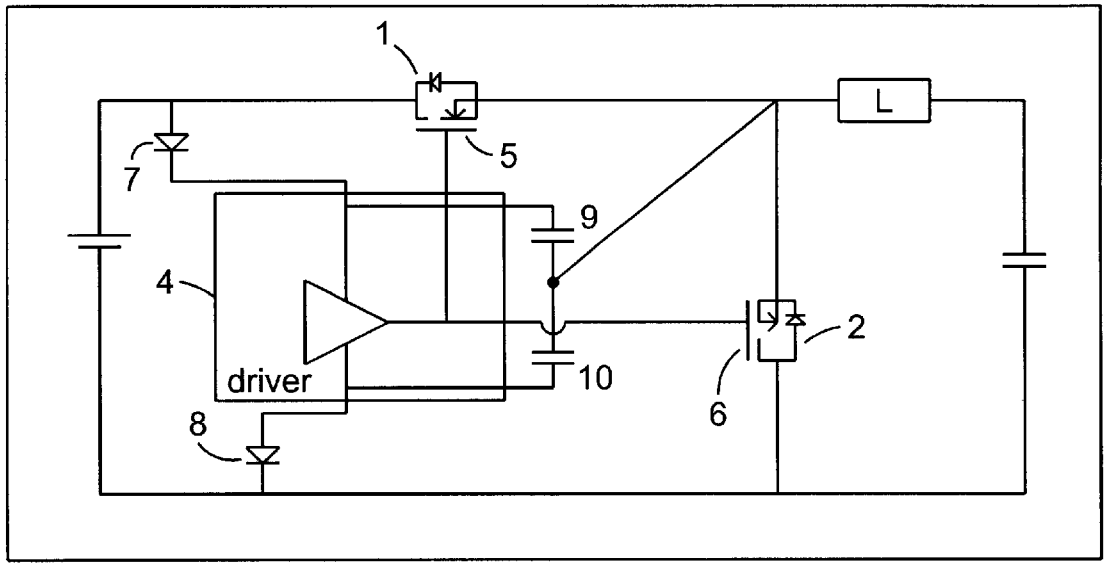
FIG. 2 shows the synchronous rectification circuit of the present invention using a single gate driver coupled to an N channel MOSFET and a P channel MOSFET.

As shown in FIG. 2, in the circuit configuration of the present invention, power MOSFET 2 is a P channel MOSFET rather than an N channel MOSFET. The driver 4 is a single channel driver rather than a dual driver. The single output node of the driver is connected to each of the two gates 5, 6. The driver utilizes a +ve and −ve drive technique to be able to drive each power MOSFET gate 5, 6 simultaneously positive and negative. Bootstrap diodes 7+ and 8− are used to charge the capacitors 9 and 10. When the voltage is +ve, power MOSFET 1 (N channel) conducts and when it is negative, power MOSFET 2 (P-channel) conducts.

Figure 3:
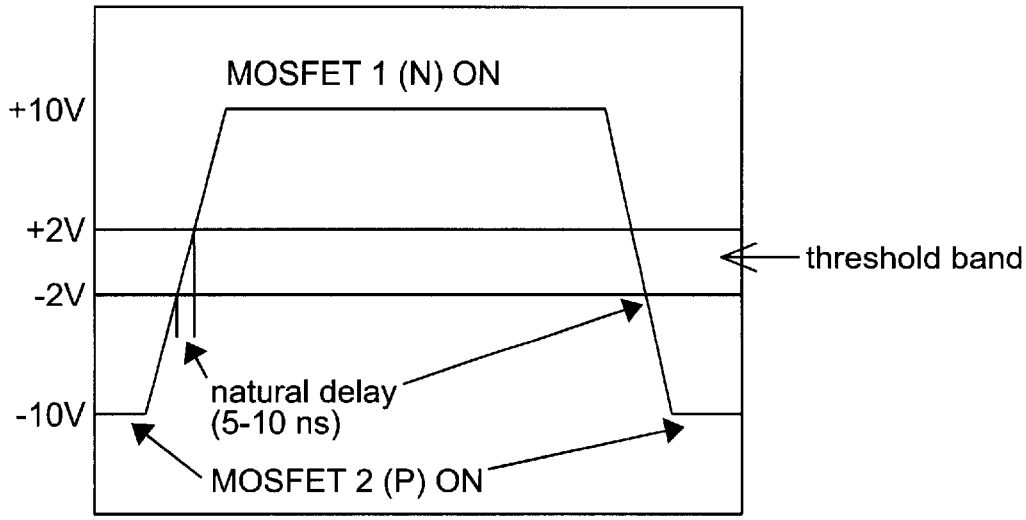
FIG. 3 shows the gate voltage with respect to the common sources as a function of time.

As there is no deadtime involved, there is very little time period where the current has a chance to cease flowing in the channel and to begin flowing through the diode. Referring to FIG. 3, if one looks at the gate voltage with respect to the common sources, there is one transition which goes from −10V to +10 V (as an example). Both MOSFETs would be non-conducting when the voltage is below respective thresholds, which would be the band between −2V to +2V (again, as an example). The time spent in this region would be typically 5–10 ns and thus the diode conduction period if any would be small.

Figure 4:
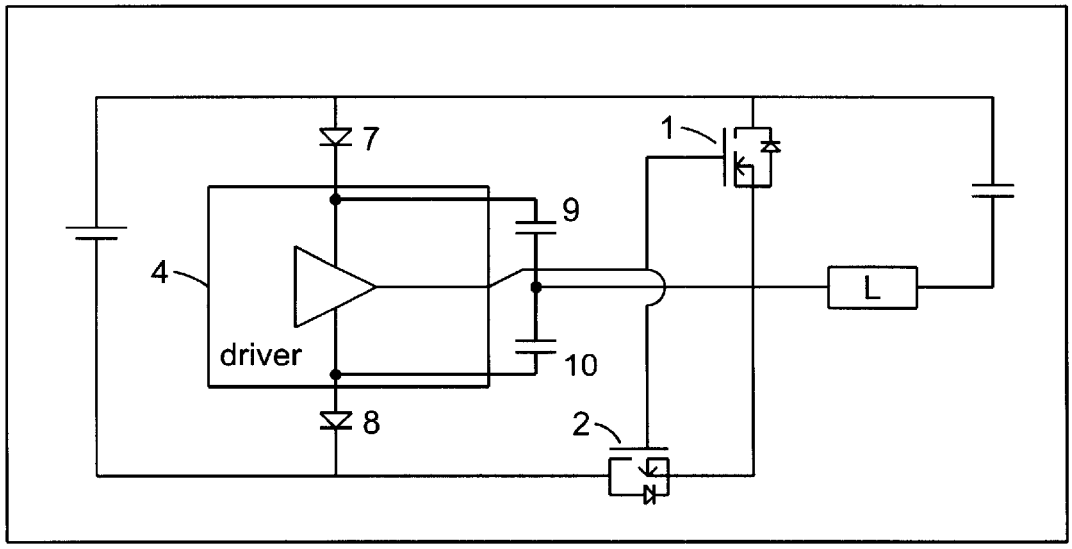
FIG. 4 shows an alternative arrangement of the switches and output filter.

An alternative arrangement of the transistor switches and output filter is shown in FIG. 4. This arrangement is useful when the input battery voltage is such that it causes the freewheeling device to have a larger time of conduction. In the previous arrangement, the P channel device (power MOSFET 2) was conducting during this freewheeling time, and normally P channel devices have a larger Rdson for the same silicon area. The present arrangement shifts the position of the filter such that the N channel device (power MOSFET 1) conducts during this time and the P channel device (power MOSFET 2) is used during the 'inductor charge cycle'.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A circuit for synchronous rectification, comprising:

first and second transistor switches connected in series between a voltage source and ground, the first and second transistor switches being connected at a connecting point, the first transistor switch being connected across an output filter;

a driver for driving said first and second transistor switches;

a first diode connected between said voltage source and a positive supply terminal of said driver, and a first capacitor connected between said positive supply terminal of said driver and the connecting point, to provide a $+V_e$ supply for said driver; and a second diode connected between ground and a negative supply terminal of said driver, and a second capacitor connected between said negative supply terminal of said driver and the connecting point, to provide a $-V_e$ supply for said driver.

2. A circuit for synchronous rectification, comprising:

a first transistor switch connected between a voltage source and an output filter, and a second transistor switch connected across the output filter and ground, the first and second transistor switches being connected at a connecting point;

a driver for driving said first and second transistor switches;

a first diode connected between said voltage source and a positive supply terminal of said driver, and a first capacitor connected between said positive supply terminal of said driver and the connecting point, to provide a $+V_e$ supply for said driver; and a second diode connected between ground and a negative supply terminal of said driver, and a second capacitor connected between said negative supply terminal of said driver and the connecting point, to provide a $-V_e$ supply for said driver.

* * * * *